US007674762B2

(12) United States Patent
Krijgsman et al.

(10) Patent No.: US 7,674,762 B2
(45) Date of Patent: Mar. 9, 2010

(54) DETERGENT COMPOSITION OR COMPONENT THEREFOR

(75) Inventors: Arie Krijgsman, Vlaardingen (NL); Elfriede Maria Langeveld, Vlaardingen (NL); Fakhruddin Esmail Pacha, Vlaardingen (NL)

(73) Assignee: The Sun Products Corporation, Wilton, CT (US)

( * ) Notice: Subject to any disclaimer, the term of this patent is extended or adjusted under 35 U.S.C. 154(b) by 932 days.

(21) Appl. No.: 10/550,638

(22) PCT Filed: Feb. 13, 2004

(86) PCT No.: PCT/EP2004/001512

§ 371 (c)(1), (2), (4) Date: Jun. 20, 2006

(87) PCT Pub. No.: WO2004/085588

PCT Pub. Date: Oct. 7, 2004

(65) Prior Publication Data

US 2007/0042929 A1 Feb. 22, 2007

(30) Foreign Application Priority Data

Mar. 24, 2003 (GB) ..... 0306790.7

(51) Int. Cl.
*C11D 17/02* (2006.01)
*C11D 3/20* (2006.01)

(52) U.S. Cl. ..... 510/441; 510/276; 510/349; 510/491

(58) Field of Classification Search ..... 510/441, 510/276, 367, 392, 491, 349
See application file for complete search history.

(56) References Cited

U.S. PATENT DOCUMENTS

| | | | | | |
|---|---|---|---|---|---|
| 2,539,012 | A | | 1/1951 | Diamond et al. | 99/143 |
| 2,589,330 | A | | 3/1952 | Purdy | 252/140 |
| 2,678,921 | A | | 5/1954 | Turck | 252/161 |
| 2,932,556 | A | | 4/1960 | Stephanou | 23/114 |
| 3,671,629 | A | * | 6/1972 | Levy et. al. | 424/680 |
| 3,925,226 | A | | 12/1975 | Takenouchi et al. | 252/92 |
| 3,927,196 | A | * | 12/1975 | Hersh | 424/452 |
| 4,196,095 | A | | 4/1980 | Cala et al. | 252/140 |
| 4,328,319 | A | * | 5/1982 | Osipow et al. | 521/78 |
| 4,395,345 | A | | 7/1983 | Walz et al. | 252/135 |
| 4,839,084 | A | | 6/1989 | Ouhadi et al. | 252/174.21 |
| 5,466,386 | A | * | 11/1995 | Stewart et al. | 252/2 |
| 6,486,111 | B1 | | 11/2002 | Zabarylo et al. | 510/314 |

FOREIGN PATENT DOCUMENTS

| | | |
|---|---|---|
| GB | 845376 | 8/1960 |
| GB | 1007839 | 10/1965 |
| WO | 92/21744 | 12/1992 |

* cited by examiner

*Primary Examiner*—Lorna M Douyon
(74) *Attorney, Agent, or Firm*—Sterne, Kessler, Goldstein & Fox P.L.L.C.

(57) ABSTRACT

A particulate detergent composition or component therefor which comprises a bi- or tri-valent carboxylic acid salt, preferably magnesium stearate, which, without the carboxylic acid salt being present, has a hygroscopicity value of greater than 25%.

10 Claims, No Drawings

DETERGENT COMPOSITION OR COMPONENT THEREFOR

TECHNICAL FIELD

The present invention relates to a particulate detergent composition or component therefor which comprises a bi- or tri-valent metal ion carboxylic acid salt.

BACKGROUND AND PRIOR ART

Modern particulate detergent composition contain a wide variety of ingredients. At the same time the consumer requires a particulate detergent composition which has acceptable physical characteristics such as, for example, being flowable and pourable in the case of powders and having good dispensing and dissolution properties in the case of tablets. The physical properties must remain acceptable even after storage for a number of weeks in the supply chain.

Many ingredients which provide a useful benefit to the detergent composition are difficult to include because they are liquid. However, liquid ingredients are not in themselves a problem as long as sufficient liquid carrying capacity is present in the solid portion of the detergent. Of more difficulty are the ingredients which are hygroscopic, which may be either liquid or solid. Hygroscopic materials are difficult to handle since they absorb atmospheric moisture over time during storage and can lead to a deleterious effect on physical properties such as undesired caking and subsequent reduction in flowability at the point of use or a reduction is dispensability, dispersability or dissolution rate.

U.S. Pat. No. 4,196,095 (Church & Dwight) discloses a carbonate based detergent composition which comprises magnesium stearate in order to reduce insoluble lump formation in cold water.

U.S. Pat. No. 2,589,330 (Swift & Co) discloses a cleansing composition comprising trisodium phosphate and silica. A magnesium compound is added to prevent caking.

The present inventors have found that specific carboxylic acid salts are especially effective at reducing the negative effects on physical properties of particulate detergent compositions or components therefor due to moisture uptake.

Thus, the present invention provides a free-flowing particulate detergent composition or component therefor which comprises a bi- or tri-valent metal ion carboxylic acid salt which, without the salt being present, has a hygroscopicity value of greater than 25%.

DETAILED DESCRIPTION OF INVENTION

The Bi- or Tri-valent Metal Ion Carboxylic Acid Salt

The carboxylic acid salt preferably has a metal ion selected from magnesium, calcium, zinc, aluminium, lead, iron or mixtures thereof, preferably magnesium.

Preferably the carboxylic acid salt has from 10 to 22, preferably from 14 to 20 carbon atoms, more preferably 18 carbon atoms. Most preferably the salt is magnesium stearate having 18 carbon atoms.

The carboxylic acid salt is preferably in particulate form. If so it preferably has a number average particle size of from 0.1 to 500 micrometers, preferably from 1 to 200 micrometers, more preferably from 2 to 100 micrometers, most preferably from 3 to 50 micrometers, or even from 3 to 20 micrometers.

The carboxylic acid salt may be present substantially homogeneously throughout the composition or component. Alternatively the carboxylic acid salt may be present at the surface of the particles at a higher concentration than the average concentration in the composition or component. In a preferred embodiment the carboxylic acid salt is present on the surface of the particles, and this is often referred to in the art as layering.

The carboxylic acid salt is preferably present at a level of from 0.1 to 10 wt %, preferably from 1 to 8 wt %, more preferably from greater than 2 to 6 wt %, or even from 2.5 to 5 wt %, based on the weight of the composition or component before addition of the carboxylic acid salt.

The carboxylic acid salt may simply be added to a previously manufactured particulate detergent composition or component. Preferably the carboxylic acid salt is particulate and is layered onto the surface of the detergent composition or component.

The Composition or Component Therefor

The present invention applies equally to detergent compositions and to components of detergent compositions which are designed to be added to an already manufactured detergent composition. For example the invention applies to detergent base powder particles made by spray-drying or granulation as well as adjunct components such as bleach or enzyme granules, perfume granules, effervescent granules etc. Preferred perfume granules comprise maltose and Polybutylmethylacrylate.

The term "hygroscopicity value", as used herein, means the level of moisture uptake by the composition or component, as measured by the percent increase in weight of the particles under the following test method. The hygroscopicity value is determined by placing 2 grams of particles (approximately 500 microns in size) in a closed container of volume 0.01 $m^3$ under conditions of 25° C. and 70% relative humidity for a period of 2 days. The percent increase in weight of the particles at the end of this time is the particles' hygroscopicity value as used herein.

Since the carboxylic acid salt reduces the negative effects of moisture uptake, the invention relates to compositions or components which are hygroscopic. It is not known whether the carboxylic acid salt reduces the amount of water uptake or whether it prevents caking without reducing water uptake.

In any case the invention applies to detergent compositions or components which, without carboxylic acid salt being present, have a hygroscopicity value of at least 2%, preferably greater than 5%, preferably greater than 10%, more preferably greater than 20%, or even greater than 30%, or even greater than 40% or even greater than 50%.

Organic Detergent Surfactant

Finished detergent compositions of the present invention contain an organic detergent surfactant. Components for detergent compositions which are also part of the invention do not necessarily comprise surfactant.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 60 wt %, preferably from 5 to 40 wt %.

Anionic surfactants are well-known to those skilled in the art. Examples include alkylbenzene sulphonates, particularly linear alkylbenzene sulphonates having an alkyl chain length of $C_8$-$C_{15}$; primary and secondary alkylsulphates, particularly $C_8$-$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred. Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkanolamides, alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising anion (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, choline esters).

Amphoteric and zwitterionic surfactants that may be used include alkyl amine oxides, betaines and sulphobetaines. In accordance with the present invention, the detergent surfactant (a) most preferably comprises an anionic sulphonate or sulphonate surfactant optionally in admixture with one or more cosurfactants selected from ethoxylated nonionic surfactants, non-ethoxylated nonionic surfactants, ethoxylated sulphate anionic surfactants, cationic surfactants, amine oxides, alkanolamides and combinations thereof.

Surfactants are preferably present in a total amount of from 5 to 60 wt %, more preferably from 10 to 40 wt %.

Detergency Builder

Finished detergent compositions of the present invention preferably contain a detergency builder, although it is conceivable that formulations without any builder are possible.

The compositions of the invention suitably contain from 10 to 80%, preferably from 15 to 70% by weight, of detergency builder. Preferably, the quantity of builder is in the range of from 15 to 50% by weight.

Preferably the builder is selected from zeolite, sodium tripolyphosphate, sodium carbonate, sodium citrate, layered silicate, and combinations of these.

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Ineos Silicas Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono- di- and trisuccinates, carboxymethyloxysuccinates, carboxymethyloxymalonates, dipicolinates, hydroxyethyl-iminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Other Detergent Ingredients

As well as the surfactants and builders discussed above, the compositions may optionally contain bleaching components and other active ingredients to enhance performance and properties.

These optional ingredients may include, but are not limited to, any one or more of the following: soap, peroxyacid and persalt bleaches, bleach activators, sequestrants, cellulose ethers and esters, other antiredeposition agents, sodium sulphate, sodium silicate, sodium chloride, calcium chloride, sodium bicarbonate, other inorganic salts, proteases, lipases, cellulases, amylases, other detergent enzymes, fluorescers, photobleaches, polyvinyl pyrrolidone, other dye transfer inhibiting polymers, foam controllers, foam boosters, acrylic and acrylic/maleic polymers, citric acid, soil release polymers, fabric conditioning compounds, coloured speckles, and perfume.

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

Although, as previously indicated, in one preferred embodiment of the invention enzymes are preferably absent, in other embodiments detergent enzymes may be present. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Product Form and Preparation

Powder detergent composition of low to moderate bulk density may be prepared by spray-drying a slurry, and optionally postdosing (dry-mixing) further ingredients. "concentrated" or "compact" powders may be prepared by mixing and granulating processes, for example, using a high-speed mixer/granulator, or other non-tower processes.

Tablets may be prepared by compacting powders, especially "concentrated" powders.

EXAMPLES

Perfume granules were made up to the following formulation using the process described in U.S. Pat. No. 6,024,943:

| Ingredient | Wt % |
|---|---|
| Polybutylmethylacrylate beads | 24 |
| Perfume | 24 |
| Maltose | 50 |
| Water | 2 |

Particulate layering agent was then added to the perfume granule. For comparative example A, no layering agent was added. 20 g of each sample of the granules were then put on open uncontrolled storage under estimated conditions of 20° C. and 40-45% RH. The results are given in the table below.

| | | | Storage time | | | |
|---|---|---|---|---|---|---|
| Example | Layering agent | wt % | 6 hours | 3 days | 6 days | 8 weeks |
| A | None | — | d | d | — | — |
| B | Zeolite A24[1] | 2% | a | b | d | — |
| C | Zeolite A24[1] | 3% | a | b | d | — |
| D | Zeolite A24[1] | 4% | a | b | d | — |
| E | Zeolite A24[1] | 5% | a | a | c | — |
| F | $CaCO_3$[2] | 2% | a | b | d | — |
| G | $CaCO_3$[2] | 5% | a | a | d | — |
| 1 | Mg-stearate[3] | 2% | a | b | b | — |
| 2 | Mg-stearate[3] | 3% | a | a | a | a |

-continued

| | | | Storage time | | | |
|---|---|---|---|---|---|---|
| Example | Layering agent | wt % | 6 hours | 3 days | 6 days | 8 weeks |
| 3 | Mg-stearate[3] | 4% | a | a | a | a |
| 4 | Mg-stearate[3] | 5% | a | a | a | a |
| H | Di calcium phosphate[4] | 2% | b | d | — | — |
| I | Di calcium phosphate[4] | 5% | a | d | — | — |

a No caking/flows well
b Light caking/flows less well
c Caking
d Heavy caking
[1]Doucil A24, supplied by Ineos Silicas
[2]Supplied by JT Baker
[3]Supplied by Acros Chemical with an $d_{3,2}$ particle size of 7.3 micrometres as measured on a Malvern Mastersizer.
[4]Supplied by Acros Chemical In a second series of experiments, magnesium stearate was compared to sodium stearate. In these examples, 50 g of the perfume granules were layered and put onto open storage under conditions of 37° C./70% RH.

The following results were obtained:

| | | | Storage time | | | |
|---|---|---|---|---|---|---|
| Example | Layering agent | wt % | 15 hours | 24 hours | 2 days | 5 days |
| 5 | Mg-stearate[3] | 3% | a | a | a | a |
| J | Na-stearate[5] | 3% | b | b | c | d |
| K | None | — | d | d | d | d |

[3]Supplied by Acros Chemical with an $d_{3,2}$ particle size of 7.3 micrometres as measured on a Malvern Mastersizer.
[5]Kemilub ES supplied by Undesa Moisture Absorption Measurements Perfume granules were layered in 2 wt % magnesium stearate, based on the total composition of the perfume granules after layering. Three types were made, granules 1, 2 and 3. For comparison purposes, two conventional modern detergent powders, free of any magnesium stearate, were also measured.

1 g samples of each particulate material were placed in a closed desiccator, which was maintained at 75% RH and 25° C. The samples were weighed after 1 or 2 days in order to measure the water uptake.

| | Perfume Granule 1 | Perfume Granule 2 | Perfume Granule 3 | Zeolit-built detergent powder | Carbonate-built detergent powder |
|---|---|---|---|---|---|
| Moisture uptake [%] 1 day | 6.9 | 7.8 | 7.6 | 12.3 | 20.9 |
| Moisture uptake [%] 2 day | 7.9 | 9.7 | 11.9 | 13.8 | 22.4 |

The invention claimed is:

1. A free-flowing particulate detergent composition or a component therefor which comprises 2.5 to 5% by weight of magnesium stearate, based on the weight of the composition or component before addition of the magnesium stearate, wherein the detergent composition or component has a hygroscopicity of at least 2% without the magnesium stearate being present, wherein the magnesium stearate is particulate and layered onto the surfaces of the detergent composition or component, wherein the magnesium stearate is present on the surface of the particles, and wherein the detergent composition or component comprises a perfume granule comprising maltose and polybutyl methylacrylate.

2. The composition or component of claim 1, wherein said hygroscopicity value is greater than 5%.

3. The composition or component of claim 1, wherein said hygroscopicity value is greater than 10%.

4. The composition or component of claim 1, wherein said hygroscopicity value is greater than 20%.

5. The composition or component of claim 1, wherein said hygroscopicity value is greater than 25%.

6. The composition or component of claim 1, wherein the magnesium stearate has a number average particle size of from 0.1 to 500 micrometers.

7. The composition or component of claim 1, wherein the magnesium stearate has a number average particle size of from 1 to 200 micrometers.

8. The composition or component of claim 1, wherein the magnesium stearate has a number average particle size of from 2 to 200 micrometers.

9. The composition or component of claim 1, wherein the magnesium stearate has a number average particle size of from 3 to 50 micrometers.

10. The composition or component of claim 1, wherein the magnesium stearate has a number average particle size of from 3 to 20 micrometers.

* * * * *